US005092109A

United States Patent [19]

Maki-Rahkola et al.

[11] Patent Number: 5,092,109

[45] Date of Patent: Mar. 3, 1992

[54] DEVICE ASSEMBLY

[75] Inventors: Jari Maki-Rahkola, Kauhajoki; Mauri J. Kōnōnen; Jorma Surakka, both of Hyvinkaa, all of Finland

[73] Assignee: Insinooritoimisto Pesmel Oy, Kauhajoki, Finland

[21] Appl. No.: 441,910

[22] Filed: Nov. 28, 1989

[30] Foreign Application Priority Data

Nov. 30, 1988 [FI] Finland ..... 885573

[51] Int. Cl.[5] ..... B65B 41/12; B65B 11/04; B65B 13/10

[52] U.S. Cl. ..... 53/587; 53/588; 53/556

[58] Field of Search ..... 53/211, 373, 389, 556, 53/587, 588, 589; 493/208

[56] References Cited

U.S. PATENT DOCUMENTS

| | | | |
|---|---|---|---|
| 2,837,884 | 6/1958 | Gibbons | 53/588 |
| 3,003,297 | 10/1961 | Broadhead | 53/588 |
| 3,968,629 | 7/1976 | Gidewall | 53/373 |
| 4,283,903 | 8/1981 | Mayhall | 53/587 |
| 4,464,219 | 8/1984 | Colombo | 493/208 |
| 4,609,367 | 9/1986 | Savich | 493/205 |
| 4,628,671 | 12/1986 | Storm | 53/588 |
| 4,716,709 | 1/1988 | Lanb | 53/587 X |

FOREIGN PATENT DOCUMENTS

| | | | |
|---|---|---|---|
| 1017523 | 10/1957 | Fed. Rep. of Germany | 53/587 |
| 2454965 | 11/1986 | France | 53/587 |

*Primary Examiner*—John Sipos

*Attorney, Agent, or Firm*—Spensley Horn Jubas & Lubitz

[57] ABSTRACT

A device assembly for wrapping a heat sealing plastic film around an article at a packing station comprises a cylindrical member having a length greater than the width of the plastic film and movable towards and away from the packing station. The cylindrical member comprises a curved external surface, a heater mounted on the curved external surface for heating the plastic film for heat bonding the plastic film to the surface of the article, a cutting device mounted in the cylindrical member for cutting the plastic film, and a retaining device provided on the external surface of the cylindrical member for retaining the trailing edge of the plastic film on the external surface.

12 Claims, 6 Drawing Sheets

DEVICE ASSEMBLY

Figure 1:
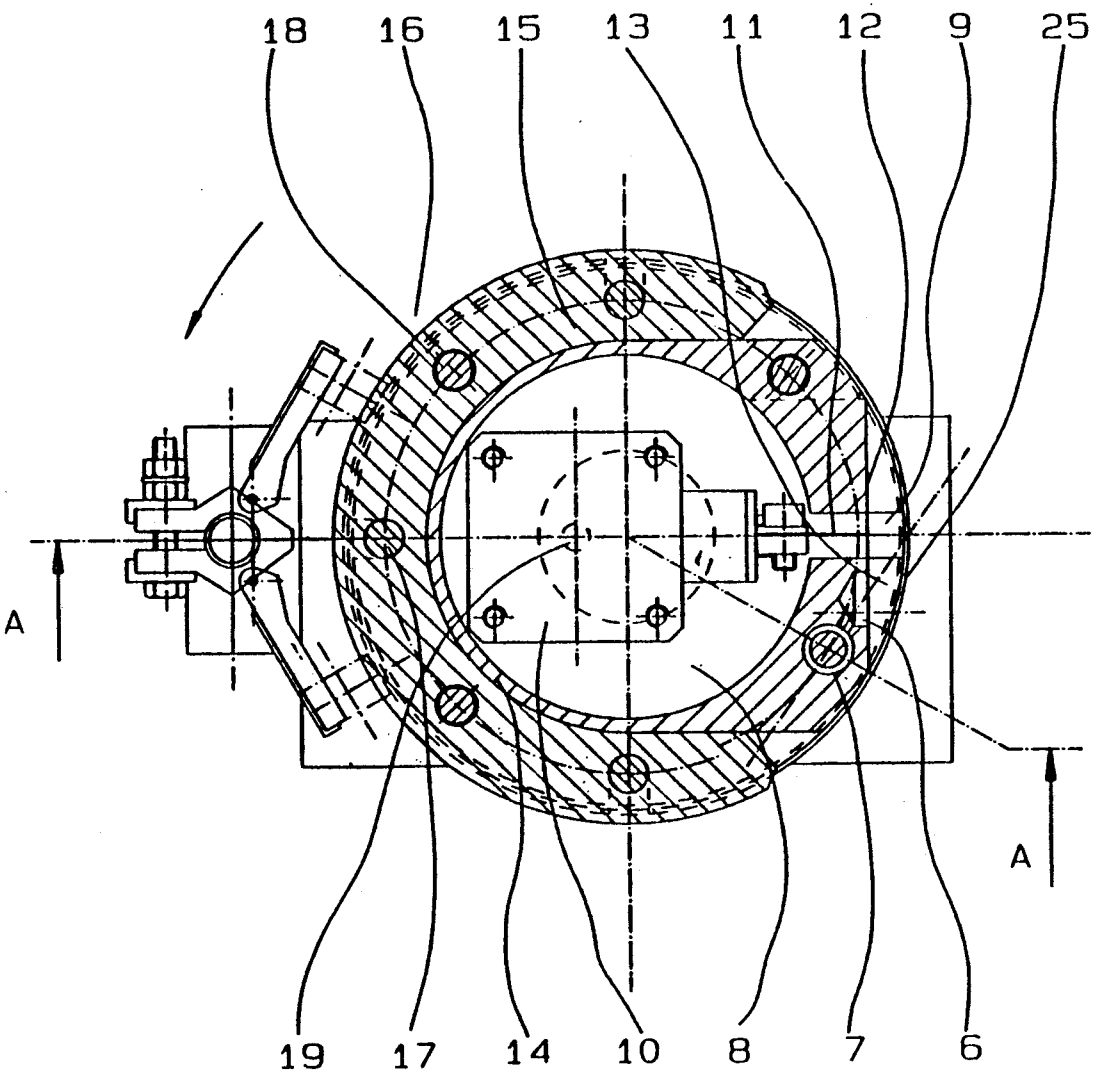

This invention relates to a device assembly in a packing machine used for wrapping a heat sealing plastic film coiled from a store roll around goods at a packing station, in particular a paper roll. This invention relates particularly to a device assembly comprising means displaceable towards the packing station for periodically pressing the plastic film against the surface of the goods at the packing station, in order to heat the plastic film disposed against the surface of the goods so as to fix it to the goods, to cut off the plastic film coiled from the store roll, detaching it from the finished roll, and to retain the detached end between wrapping periods.

In packing machines of the above type, separate means have been used to accomplish the above functions, and thus the purpose of the present invention is to provide a device assembly that is less complicated, more economical and of easier maintenance than before, capable of being used in circumferential wrapping as well as longitudinal wrapping and by means of which the plastic film is cut off and fixed to the wrapping with an accuracy that does not leave ends hanging the way they have so far.

Thus, according to the invention, an extremely compact device assembly is provided, comprising transversely and preferably a member having a curved surface, having preferably a length at least equal to the width of the plastic film, mounted pivotably and oscillating and displaceable towards the packing station and away from it, the curved surface comprising at least two of the following zones, i.e. a heating zone, a retaining zone and a cutting zone. The retaining zone comprises preferably in the longitudinal direction of the member having a curved surface at least one longitudinal slot or several consecutive inlets connected to an aspirating canal in a cylinder, and the cutting zone comprises preferably a slot having a length at least equal to the width of the plastic film and extending into the hollow inside of the member having a curved surface, intended for the cutter disposed inside it and movable to and fro in the slot and emerging from the slot as it moves.

The device actuating the cutter can be disposed either inside the member having a curved surface or outside it, whereby it is connected to the cutter inside by means of an axial arm.

By means of the invention, the heat sealing, retaining and cutting of a plastic film required by a packing machine is taken care of by a device assembly, in which two or even all three of the above functions are accomplished by one exclusive member which is relatively simple, economical and easy to service and having a curved surface, such as a combined cylinder. In one embodiment of the invention, the circumference of the combined cylinder comprises a segment in the retaining and/or cutting zone in order to form a plane, the axial length of which is at least equal to the width of the plastic film, but so much less than the length of the cutting zone slot that the cutter in its extreme positions remains outside the plane covered by the slot in the uncut rear end of the cylinder.

In the member having a curved face according to the invention, the heating, retaining and cutting zones can be disposed immediately next to each other, so as to get the end of the plastic film heat sealed to the wrapping nearly up to the cutting point, thus leaving only a very short portion of the plastic film hanging in the wrapping.

The heating zone, again, preferably extends over 180° around the circumference used as the member having a curved surface and has essentially the same width as the plastic film. The cylinder surface can be axially composed by several cylindrical pieces and interposed heated plates having the shape of a circular sector, the cylindrical pieces being preferably coated with Teflon or some similar material, to which the plastic film does not easily adhere. The outer diameter of the plates shaped as a circular sector is also preferably somewhat greater than the one of the interposed cylindrical pieces, so that the plates emerge somewhat from the circumferential surface of the cylinder.

The member having a curved surface according to the invention such as a combined cylinder, can be disposed rotatably at the end of an arm mounted onto bearings, the arm being connected by an actuating cylinder or similar to the frame of the packing machine in order to provide a rotating motion of the arm. The arm can preferably be rotated by means of the actuating cylinder so far that the member or the cylinder in one extreme position is flexibly against the goods at the packing station, and in the other extreme position with regard to the goods on the opposite side of the trajectory of the plastic film spaced from this, between the starting and the finishing of the wrapping.

Figure 2:
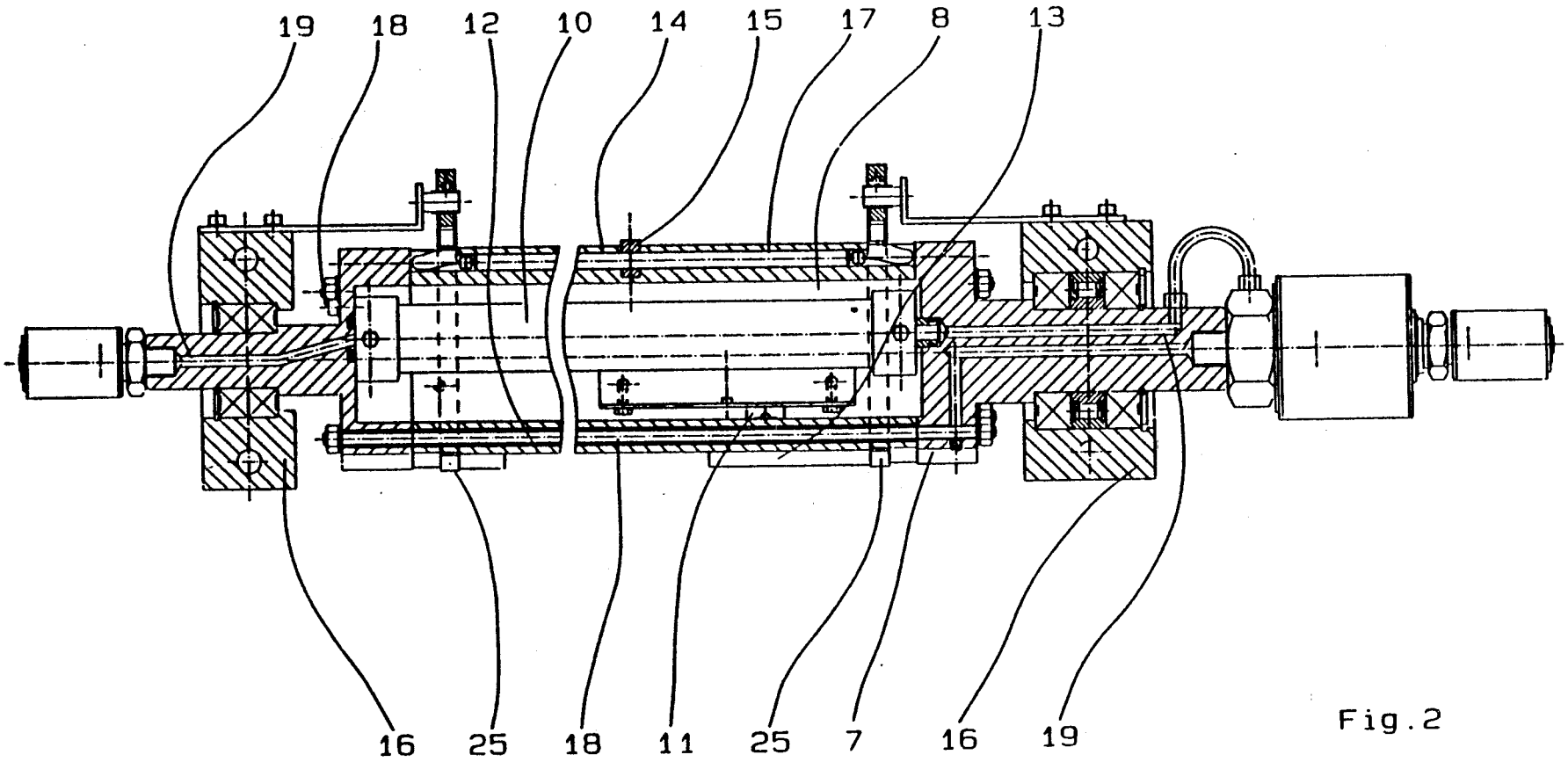
Figure 3:
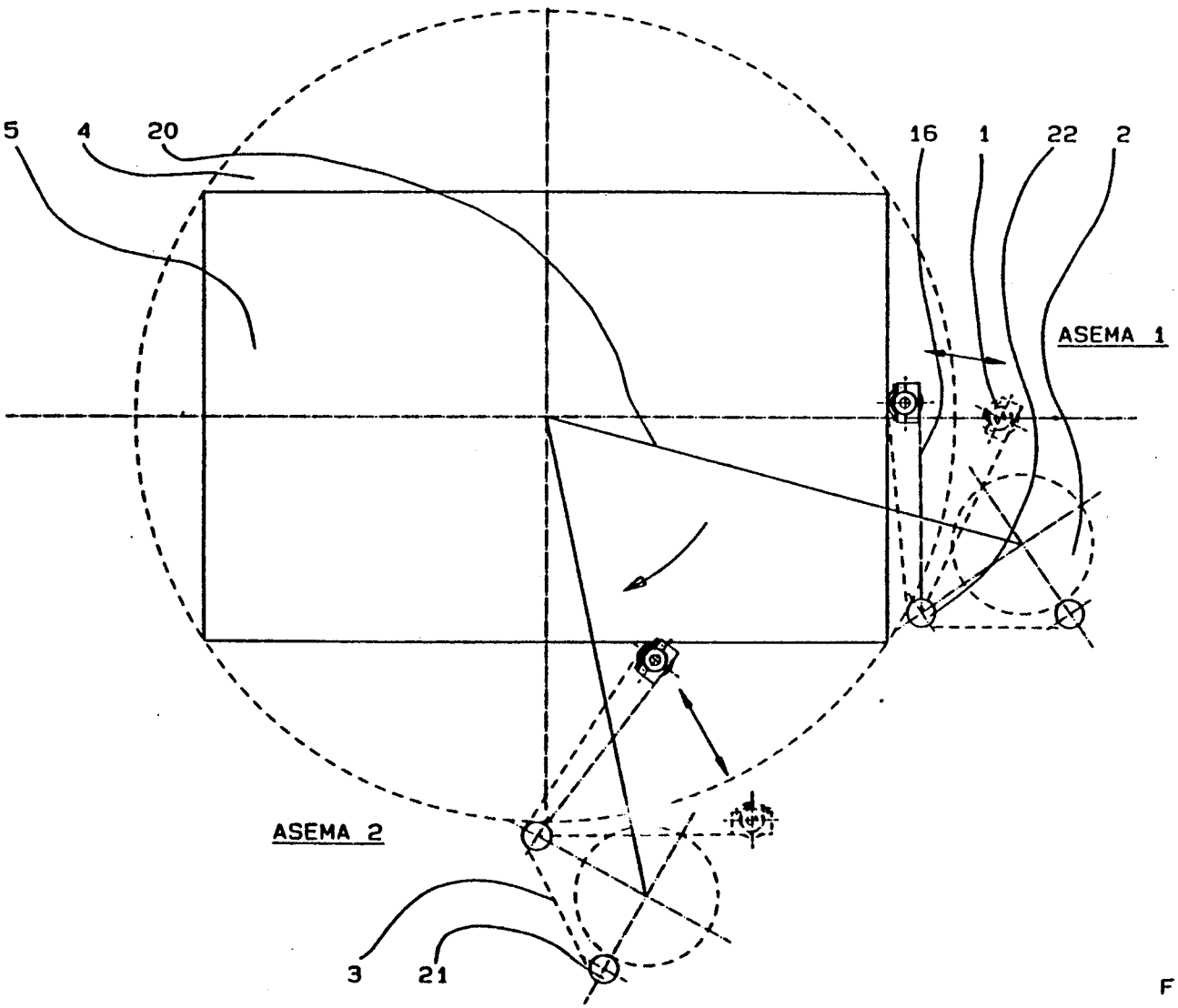
Figure 4:
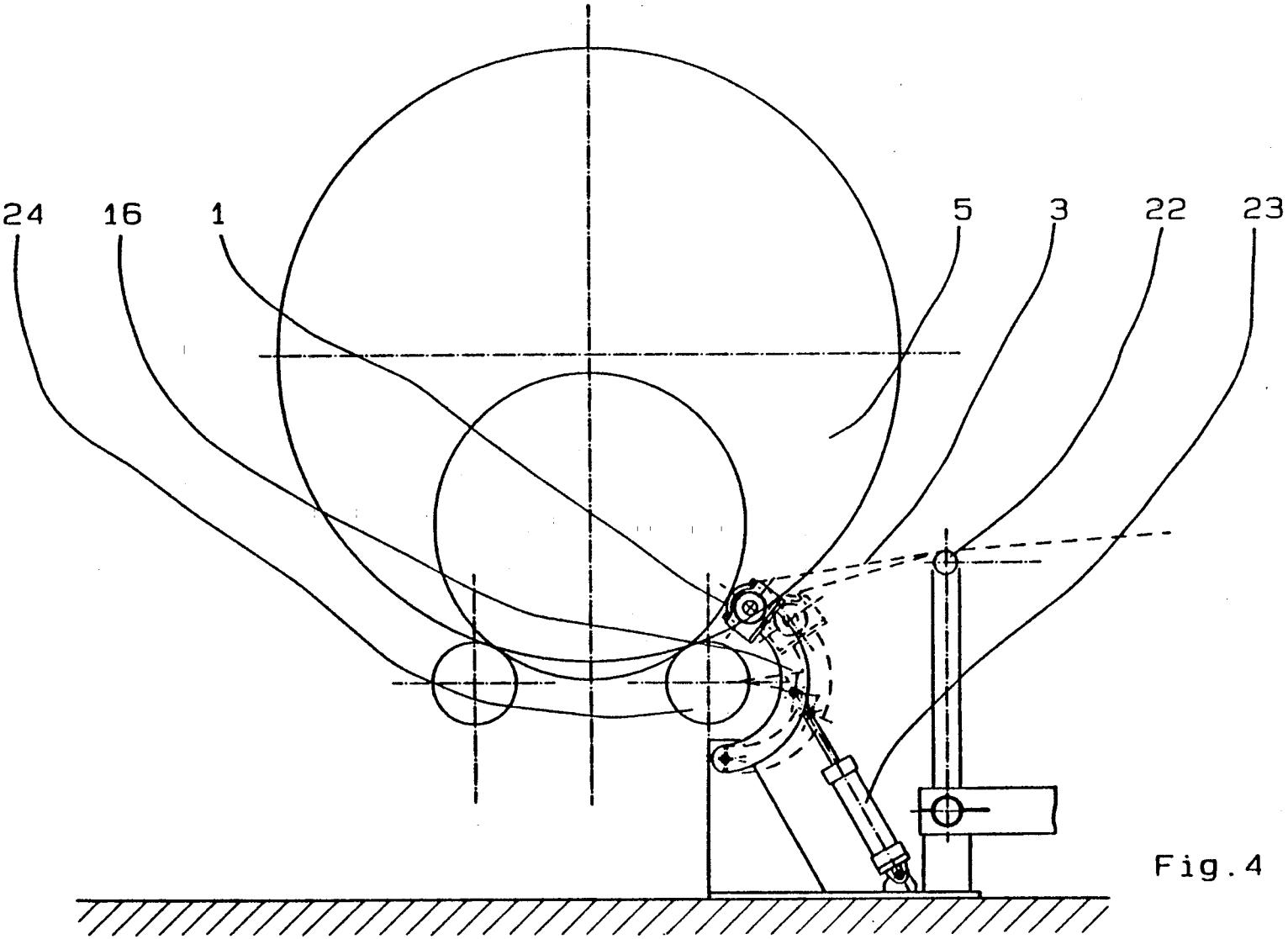
Figure 5:
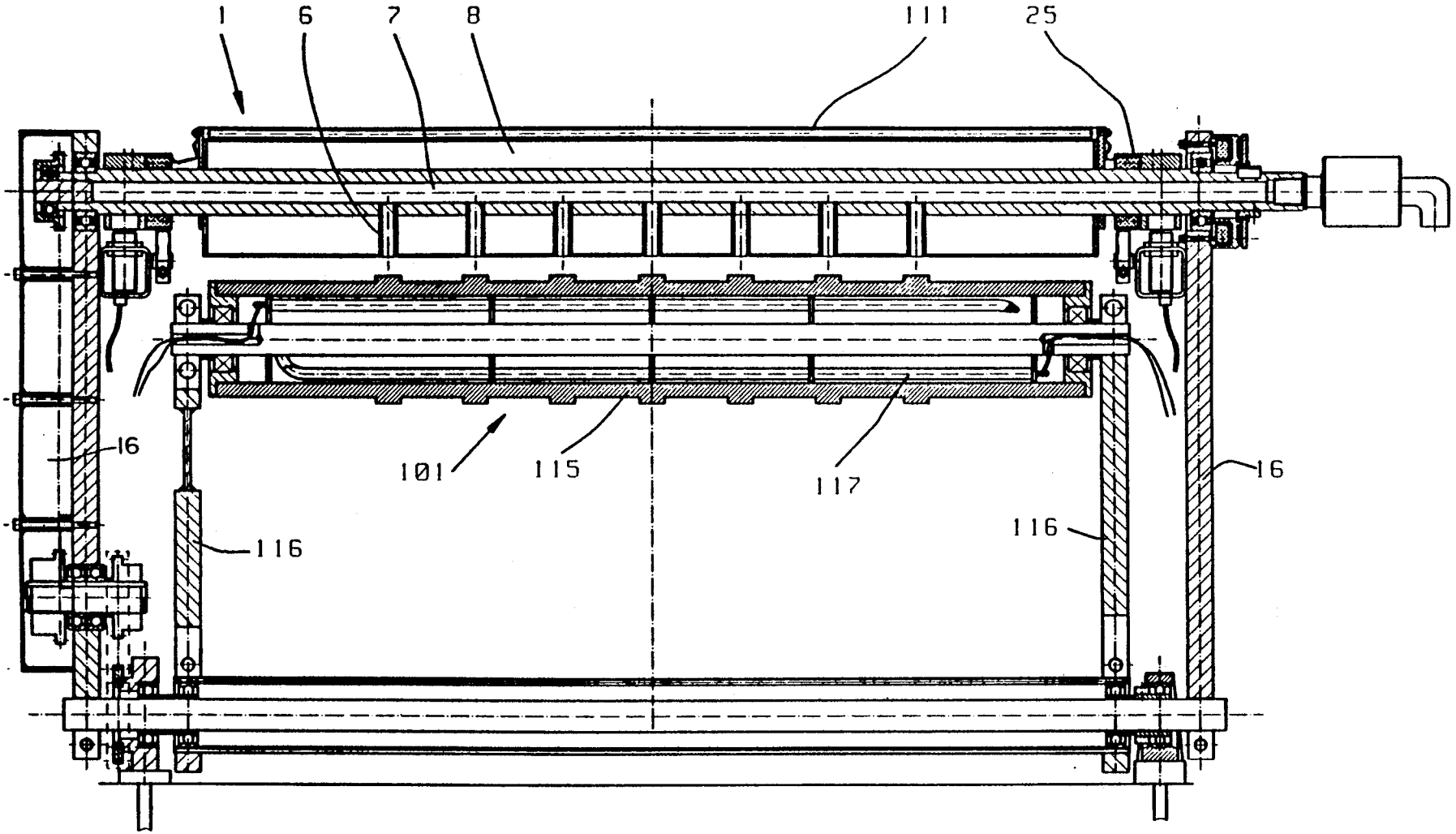
Figure 6:
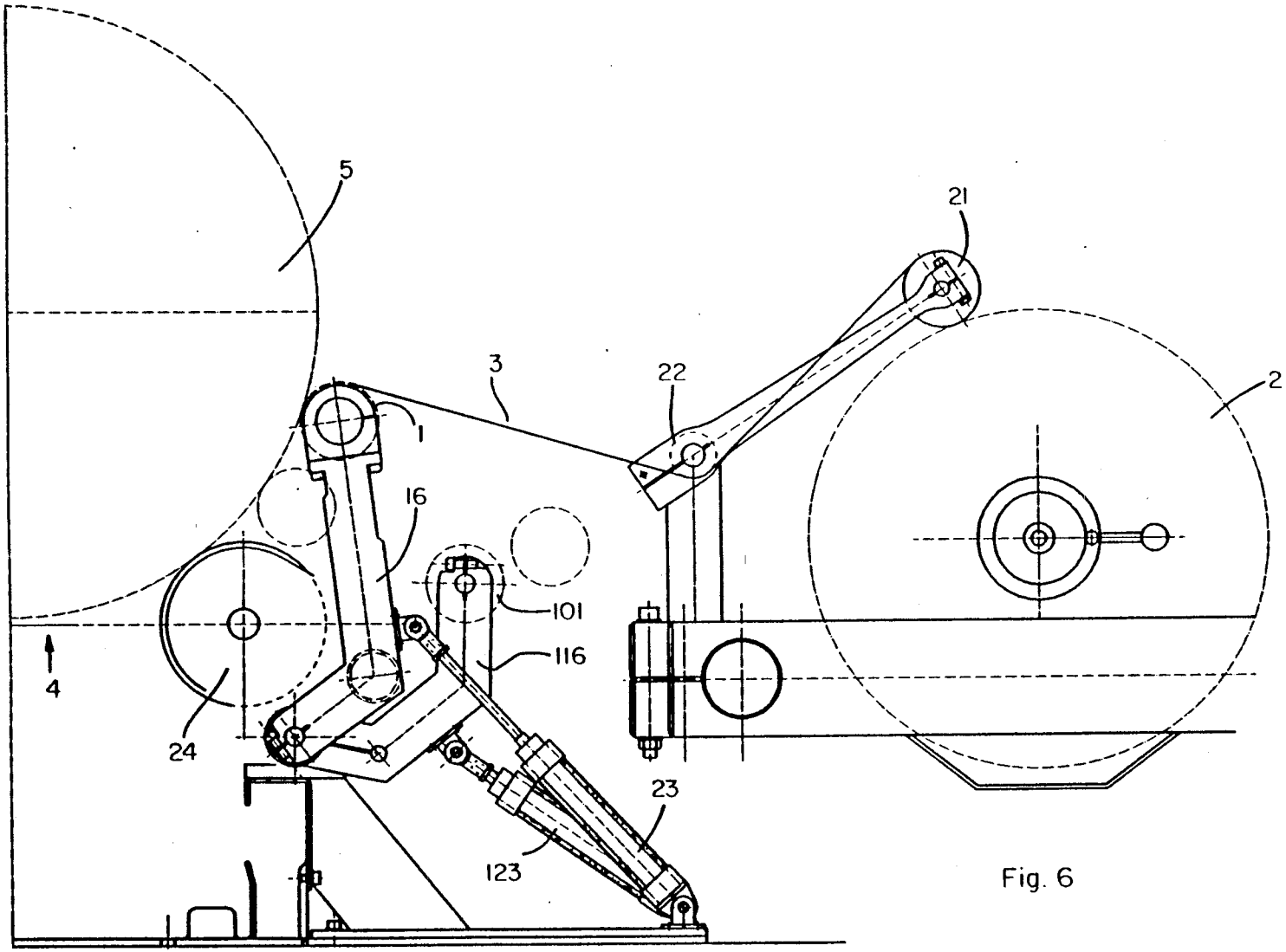

The invention is described in greater detail below with reference to the enclosed drawings, in which FIG. 1 shows a cross-section of an end view of the combined cylinder according to the invention, FIG. 2 is a section along the line A—A of FIG. 1, FIG. 3 shows a schematic top view of the combined cylinder of FIGS. 1 and 2 disposed in a longitudinal wrapping machine and at two stations, i.e. the wrapping finishing station (station 1) and the wrapping starting station (station 2), FIG. 4 shows a side view of the combined cylinder of FIGS. 1 and 2 disposed in a circumferential wrapping machine, FIG. 5 shows a cross-section of a side view of a preferred embodiment of the invention, and FIG. 6 shows a side view of the combined cylinder of FIG. 5 disposed in a circumferential wrapping machine.

In the device assembly according to the invention, the cylinder forming the member with a curved surface is generally indicated with the reference number 1 in the drawings, and its construction is shown in detail in FIGS. 1 and 2. FIGS. 1 and 2 show that the cylinder 1 is hollow and that its hollow inside 8 comprises a pneumatic cylinder 10 operating axially into both directions and connected to an outer compressed air source by the canal 19, which actuates a radial cutter 11, which again extends outside the also radial slot 9 in the circumferential wall of the cylinder 1, moving back and forth from one end to the other in this slot 9. In addition, a segment has been cut in the mantle of the cylinder 1 in order to form a level 12 on each side of the slot 9. The axial length of the level 12 is at least equal to the width of the heat sealing plastic film used for the wrapping and the cutting is deep enough for the cutter 11, as it moves, to project somewhat from the level 12 in order to cut off the plastic film disposed against the level 12 as the cutter 11 is moving. The slot 9 is so much longer than the level 12, that the cutter 11 in its extreme positions, at either end of the slot 9, is covered by the uncut end 13 at either end of the cylinder 1 and thus does not damage the plastic film or the wrapping as the cylinder 1 rotates within contact with these. The uncut end portions of the cylinder 1 are indicated by the reference number 13 and the rotating direction of the cylinder by an arrow.

In addition, a plurality of axially spaced aspirating inlets 6 open up into the level 12 in front of the slot 9 and the cutter 11 in it viewed in the rotating direction, which inlets 6 communicate with the aspirating canal 7 in the mantle wall of the cylinder 1 in order to retain the plastic film disposed against the level 12 and in particular in order to retain the end of the plastic film path separated from the wrapping by cutting inbetween wrapping periods. The length of the inlet row 6 is preferably essentially equal to the width of the plastic film used for the wrapping extending essentially over the entire length of the level 12.

The combined cylinder 1 is composed of a plurality of sleeve-like pieces 14 having poor heat conductivity, whose surface is preferably coated with a material such as Teflon to which the wrapped plastic film adheres poorly. Interposed between the sleeve-like pieces 14 are plates 15 having the shape of a circular sector, which are of a material having good heat conductivity, such as metal, and the outer diameter of the plates 15 being slightly greater than the one of the sleeve-like pieces 14, so that the plates 15 project from the circumferential surface of the cylinder 1. The plates 15 are interconnected by heat resistors 17 extending axially in the circumferential wall of the cylinder 1, the heat resistors being connected by a slide ring 25 to an outside power source for heating of the plates 15. The sleeve-like pieces 14 with the interposed plates 15 are also interconnected by connecting bolts 18 extending through the circumferential wall of the cylinder 1 axially from one end to the other.

Thus the level 12 forms a cutting zone at the point of the slot 9 together with the retaining zones (inlets 6) in the rotating direction in front of it and the heated plates 15 define a heating zone, which extends about ¾ around the circumference of the cylinder 1.

The combined cylinder according to the invention can be preferably used in circumferential wrapping, in which a plastic film is helically wrapped around the mantle of a rotating paper roll, as well as in longitudinal wrapping, in which a plastic film is wrapped on the level of the axis of the paper roll around its ends while the paper roll is being rotated around its axis.

The use of a combined cylinder according to the invention in a longitudinal wrapping machine is illustrated in FIG. 3. The paper roll 5 located at the goods station 4 is rotated around its longitudinal axis while the plastic film 3 is wrapped horizontally around the paper roll 5. A store roll 2 of plastic film is disposed at the end of the arm 20, which rotates around a vertical axis at the centre of the goods station 4 in the direction indicated by the arrow. In the arm 20, rotating along with it, are additionally disposed a brake roll 21 disposed against the store roll 2, the plastic film 3 being directed over the brake roll, and further a creasing roll 22. The multi-function cylinder 1 according to the invention, again, is disposed at the end of another arm 16, which is disposed to turn around the axis of the creasing roll 22. By turning the arm 16 towards the goods station 4, the cylinder 1 can be brought against the plastic film 3 and the plastic film 3 again forced against the paper roll 5.

The wrapping is started at the station 2 in FIG. 3, as the cylinder 1 retaining the cut off end of the plastic film 3 moves against the paper roll 5. Subsequently, the arm 20 is turned slowly in the direction of the arrow, so that the plastic film stays between the heating zone of the cylinder 1 and the paper roll 5, the end of the plastic film 3 being then welded to the paper roll 5. At the same time, the aspiration is stopped in the retaining zone and the cylinder 1 having turned about half a lap in order to seal the end of the plastic film 3 to the paper roll 5, the arm 16 and the cylinder 1 at its end are turned away from the paper roll 5 into the position marked with a dotted line at the station 2. After this, the paper roll 5 starts rotating around its longitudinal axis and simultaneously the arm 20 starts turning horizontally around the paper roll 5 at the wrapping rate. In the position indicated by dotted lines at station 2 the cylinder 1 is not in contact with the plastic film 3 coiled from the store roll 2.

The ending of the wrapping is shown at station 1 in FIG. 3. The wrapping is finished by stopping the arm 20 and simultaneously the rotation of the paper roll 5 around its longitudinal axis stops. The cylinder 1 moves from its position marked by dotted lines at station 1 towards the paper roll 5 pressing the plastic film 3 towards the end of the paper roll 5. Subsequently, the arm 20 is slowly turned around its vertical axis so that the cylinder 1 rotates, sealing the plastic film 3 against the end of the paper roll 5. Then the arm 16 is turned away from the end of the paper roll 5 so much that the cylinder 1 no longer presses the plastic film 3 against the end of the paper roll 5, but its plane part 12 is still in contact with the plastic film 3. The aspirating canal 7 is brought into an aspirating state in order to retain the plastic film and the pneumatic cylinder 10 is put into operation in order to transfer the cutter 11 from one end to the other of the cylinder to cut the film 3. Finally the cylinder 1 retaining the end of the cut off plastic film 3 is transferred at the station 1 into the extreme position indicated b dotted lines at station 1. The paper roll 5 wrapped into the plastic film is removed from the goods station 4, a new paper roll is brought to the goods station 4, the arm 20 is turned to station 2 and the wrapping is started, as described above.

In the circumferential wrapping machine shown in FIG. 4 the paper roll 5 at the goods station 4 is supported by two rolls, of which the one 24 shown in the figure additionally rotates the paper roll 5 around its longitudinal axis in the direction of the arrow. The plastic film 3 coming from the store roll is directed over the creasing roll 22 between the roll 24 and the paper roll 5 above it.

The multi-function cylinder 1 according to the invention is disposed between the creasing roll 2 and the supporting and driving roll 24 in the frame of the packing machine at the upper end of the arm 16 mounted articulatedly onto bearings, the arm 16 and the multi-function cylinder 1 at its end being movable towards the roll 5 and thus away by means of the multi-function cylinder 23 positioned between the arm 16 and the packing machine frame. When starting the wrapping, the multi-function cylinder 1 retaining the end of the plastic film 3 is moved against the paper roll to be packed at the goods station 4, upon which the paper roll 5 is slowly rotated by the roll 24 and simultaneously the aspiration is stopped in the aspirating zone of the cylinder 1 so that the end of the plastic film 3 is liberated, following the surface of the paper roll 5, while the plastic film 3 under the effect of the heating zone of the cylinder 1 is fixed by welding to the surface of the paper roll 5. The cylinder 1 having rotated about half a lap, it is pulled away from the paper roll 5 into its other extreme position indicated by dotted lines, in which it is not in contact with the plastic film 3 and the wrapping is continued at a normal rate, until the wrapping covering helically the entire cylindrical surface of the paper roll 5 is finished. After this, the cylinder 1 is again forced against the wrapped roll 5 into the intermediate position indicated by dotted lines in FIG. 3 in order to heat seal the plastic film 3 to the surface of the wrapped paper roll 5. Finally the roll 24 supporting the wrapped paper per roll 5 is stopped, as the plane part 12 of the cylinder 1 is disposed against the plastic film 3, the cylinder 1 is pulled slightly apart from the wrapped paper roll 5, while the canal 7 of the cylinder 1 is brought into an aspirating state and the cutter 11 is activated in order to cut the plastic film path 3 and to retain its end while the packed paper roll 5 is removed and a new paper roll is brought to the goods station 4, and finally a new wrapping period is started in the manner described above.

For the retaining of the end of the plastic film, the aspirating inlets can be replaced by e.g. spaced gripping claws pivoting around a shaft disposed into a cavity formed longitudinally on the circumference of the multi-function cylinder. When emerging pivotally from the cavity, the claws grip the plastic film disposed against the cylinder and press it against the surface of the cylinder.

The movable cutter, again, can be replaced by a cutter whose length is essentially equal to the width of the plastic film, fixed into a cavity formed longitudinally on the circumference of the multi-function cylinder. The plastic film disposed against the surface of the multi-function cylinder is then aspirated into the cavity and thus against the cutter by means of the aspirating inlets opening up into the cavity, which can act simultaneously as retaining means.

The cylinder 1 can be replaced by some other member having a curved surface but not necessarily an arched surface, which then can be mounted onto bearings so as to oscillate, the reverse motion taking place when it is not in contact with the plastic film or packing.

Instead of one cylinder, two separate cylinders can be used, the one taking care of two functions, preferably the retaining and the cutting, whereas the other acts exclusively as a heating cylinder. Such an embodiment of the invention is shown in FIGS. 5 and 6.

As shown in FIG. 6, the circumferential wrapping machine is equipped, besides the cylinder 1 of the invention, also with a second cylinder 101, which is mounted onto bearings at the end of the arm 116, the arm 116 being disposed by means of the cylinder 123 to rotate around the same axis as the arm 16 of the cylinder 1. The cylinders 1 and 101 can thus independently of each other be pressed against the paper roll 5 and turned away from it. In FIG. 6, the cylinder 1 according to the invention is pressed against the paper roll, whereas the second cylinder 101 is detached from it. The other extreme position of the cylinders 1 and 101 is schematically indicated by dotted lines in FIG. 6.

As shown more in detail in FIG. 5, the circumference of the cylinder 1 of the invention comprises an axial row of aspirating inlets 6, which are connected through canal 7 over the axis of the cylinder 1 to an outside pressure source (not represented). On the opposite side of the circumference of the cylinder 1 an axial resistor element 111 is provided for cutting the plastic film 3, which heating element 111 is connected by a slide ring 25 to an outside power source for heating of the heating element 111. The second cylinder 101, i.e. the sealing cylinder, is formed of a cylinder mantle 115 comprising ridges, on top of which a teflon mantle is disposed, to which the wrapped plastic film adheres poorly, and of heating elements 117 disposed inside the mantle 115, the elements being connected over the axis of the cylinder 101 to an outside power source (not shown). The cylinder 101 merely carries out the sealing of the plastic film 3 to the paper roll 5, whereas the cylinder 1 of the invention carries out two functions, i.e. the retaining and the cutting of the end of the plastic film 3.

We claim:

1. A device assembly for wrapping a heat sealing plastic film around an article at a packing station, the device assembly comprising:

a longitudinal member movable with respect to the packing station and adapted to bring the plastic film in contact with the surface of the article at the packing station;

wherein said longitudinal member is rotatable about an axis thereof and comprises a curved external surface adapted to engage the plastic film, heating means mounted adjacent the curved external surface for periodically heating the plastic film engaging the longitudinal member sufficiently to allow heat bonding of the plastic film to a previously wrapper layer of film on the surface of the article, cutting means mounted in said longitudinal member for periodically cutting the plastic film, and retaining means provided adjacent the external surface of said longitudinal member for periodically retaining the cut off end of the plastic film on the external surface.

2. A device assembly according to claim 1, wherein said retaining means comprises in the longitudinal direction of the longitudinal member at least one aspirating inlet in the surface of the longitudinal member, and an aspirating canal provided in the longitudinal member which communicates with said aspirating inlet.

3. A device assembly according to claim 1, wherein said longitudinal member is cylindrical and defines a hollow core and said cutting means comprises a slot provided in the surface of said longitudinal member having a length at least equal to the width of the plastic film and extending into the hollow core of the cylinder, said cutter means being movably mounted within said longitudinal member so as to be movable along the slot and emerging from the slot as it moves.

4. A device assembly according to claim 3, wherein said longitudinal member is a cylinder including in the outer surface thereof a leveled surface area adjacent said retaining means and said cutting means, said leveled surface area having an axial length at least equal to the width of the plastic film but less than the length of the slot of said cutting means, wherein said cutter means in its extreme positions stays in said slot but outside said leveled surface area.

5. A device assembly according to claim 1, wherein said retaining and cutting means are provided in the immediate vicinity of each other.

6. A device assembly according to claim 4, wherein said heating means covers an area extending radially over 180° around the circumference of the cylinder and longitudinally essentially the width of the plastic film.

7. A device assembly according to claim 4, wherein said cylinder axially comprises a plurality of cylindrical pieces and a plurality of heating plates each having the shape of a circular sector interposed between said cylindrical pieces.

8. A device assembly according to claim 7, wherein the outer diameter of said heating plates is greater than the diameter of tyhe interposed cylindrical pieces, so that the heating plates project from the circumferential surface of the cylinder.

9. A device assembly according to claim 1 further comprising actuation means for periodically moving said longitudinal member towards and away from the packing station, said actuation means comprising an arm member having a pivot at one end thereof for rotatably supporting said longitudinal member around the pivot and actuating cylinder means coupled to said arm member for providing a rotating motion to said longitudinal member.

10. A device assembly according to claim 9, wherein said arm member is rotated by said actuating cylinder means so that said longitudinal member, in one of its extreme positions, is flexibly retained against the article at the packing station, and in the other extreme position with regard to the article, said longitudinal member is retained a distance removed from the trajectory of the plastic film which lies between the article and said longitudinal member.

11. In a packing machine in which a heat sealing plastic film is wrapped around an article at a packing station, and in which the plastic film is intermittently brought into contact with the surface of the article, heat-bonded to another film layer on the surface of the article and cut off, the improvement comprising:

a longitudinal member for bringing the plastic film in contact with the surface of the article at the packing station, said longitudinal member having heating means for heating the plastic film engaging said longitudinal member sufficiently to allow heat bonding of the plastic film to the previously wrapped layer of film, cutting means mounted in said longitudinal member for cutting the plastic film, and retaining means for retaining the cut off end of the plastic film on the external surface of the longitudinal member.

12. A device assembly for wrapping a heat sealing plastic film around an article at a packing station, the device assembly comprising:

a generally cylindrical member defining a hollow core therein movable with respect to the packing station and adapted to bring the plastic film in contact with a previously wrapped layer of film on the surface of the article at the packing station;

said cylindrical member comprising axially a plurality of cylindrical pieces and a plurality of heating plates each having the shape of a circular sector interposed between said cylindrical pieces, said heater plates having heater means coupled thereto for heating the plates, said heating plates being provided adjacent the external surface of said cylindrical member and covering an area extending radially over 180° around the circumference of the cylinder and longitudinally approximately the width of the plastic film;

said cylindrical member further comprising in the outer surface thereof a slot provided in the surface thereof and having a length at least equal to the width of the plastic film and extending into the hollwo core of the cylinder, and a leveled surface area adjacent said slot having an axial length at least equal to the width of the plastic film but less than the length of said slot;

a cutter movable within the member slot;

pneumatic means mounted within said cylindrical member for operating the cutter so as to move the cutter along the slot and to project the cutter beyond the leveled surface area as it moves, wherein said cutter in its extreme positions stays in said slot but outside leveled surface area;

a plurality of aspirating inlets provided in the longitudinal direction of said cylindrical member in the leveled surface area of said cylindrical member; and an aspirating canal provided in the cylindrical member which communicates with said aspirating inlet.

* * * * *